US007093900B1

(12) United States Patent
Schon

(10) Patent No.: US 7,093,900 B1
(45) Date of Patent: Aug. 22, 2006

(54) SEAT

(76) Inventor: Gisela Schon, Mittelstrasse 51, D-52379 Langerwehe (DE) 52379

( * ) Notice: Subject to any disclaimer, the term of this patent is extended or adjusted under 35 U.S.C. 154(b) by 0 days.

(21) Appl. No.: 09/807,410

(22) PCT Filed: Oct. 19, 1999

(86) PCT No.: PCT/DE99/03352

§ 371 (c)(1),
(2), (4) Date: Apr. 19, 2001

(87) PCT Pub. No.: WO00/22964

PCT Pub. Date: Apr. 27, 2000

(30) Foreign Application Priority Data

| | | |
|---|---|---|
| Oct. 19, 1998 | (DE) | 198 48 074 |
| Nov. 3, 1998 | (DE) | 198 50 529 |
| Jun. 2, 1999 | (DE) | 199 25 158 |

(51) Int. Cl.
*A47C 1/02* (2006.01)

(52) U.S. Cl. ..... 297/344.11; 297/344.24; 297/259.4; 297/68; 297/423.25

(58) Field of Classification Search ..... 297/344.11, 297/344.13, 344.14, 344.15, 344.24, 259.3, 297/259.4, 217.3, 68, 69, 70, 423.25, 260.1, 297/260.2; 248/415, 416, 425, 429; 296/65.01
See application file for complete search history.

(56) References Cited

U.S. PATENT DOCUMENTS

| | | | | |
|---|---|---|---|---|
| 2,520,563 | A * | 8/1950 | Preston | 5/109 |
| 3,280,462 | A * | 10/1966 | Deeley, Jr. | |
| 4,650,249 | A * | 3/1987 | Serber | 297/313 |
| 5,042,800 | A * | 8/1991 | Walter | 482/142 |
| 5,054,857 | A * | 10/1991 | Kvalheim | 297/423.13 |
| 5,295,728 | A * | 3/1994 | Schaevitz | 297/195.1 |
| 5,330,254 | A * | 7/1994 | Larson | 297/354.11 |
| 5,427,433 | A * | 6/1995 | Holobaugh, Jr. | 297/273 |
| 5,582,464 | A * | 12/1996 | Maymon | 297/487 |
| 5,584,460 | A * | 12/1996 | Ropp | 297/344.1 X |
| 5,720,462 | A * | 2/1998 | Brodersen | 297/344.21 X |
| 5,765,910 | A * | 6/1998 | Larkin et al. | 297/172 |
| 5,765,916 | A * | 6/1998 | Patel | 297/344.13 |
| 5,865,505 | A * | 2/1999 | Eley | 297/354.13 |
| 5,909,925 | A * | 6/1999 | Glockl | 297/314 |
| 6,042,145 | A * | 3/2000 | Mitschelen et al. | 280/735 |
| D432,804 | S * | 10/2000 | Mizelle et al. | D6/360 |
| 6,626,494 | B1 * | 9/2003 | Yoo | 297/296 |

FOREIGN PATENT DOCUMENTS

| | | | |
|---|---|---|---|
| EP | 0161062 | * | 11/1985 |
| FR | 2569965 | * | 8/1983 |
| GB | 2171610 A | * | 9/1986 |

* cited by examiner

*Primary Examiner*—Laurie K. Cranmer
(74) *Attorney, Agent, or Firm*—Gudrun E. Huckett

(57) ABSTRACT

The invention relates to a seat with a stable base wherein the angle of inclination of the seating surface can be moved around a pivot provided between the base and the seating surface, the latter being forced to move continuously and cyclically.

21 Claims, 11 Drawing Sheets

Fig. 8
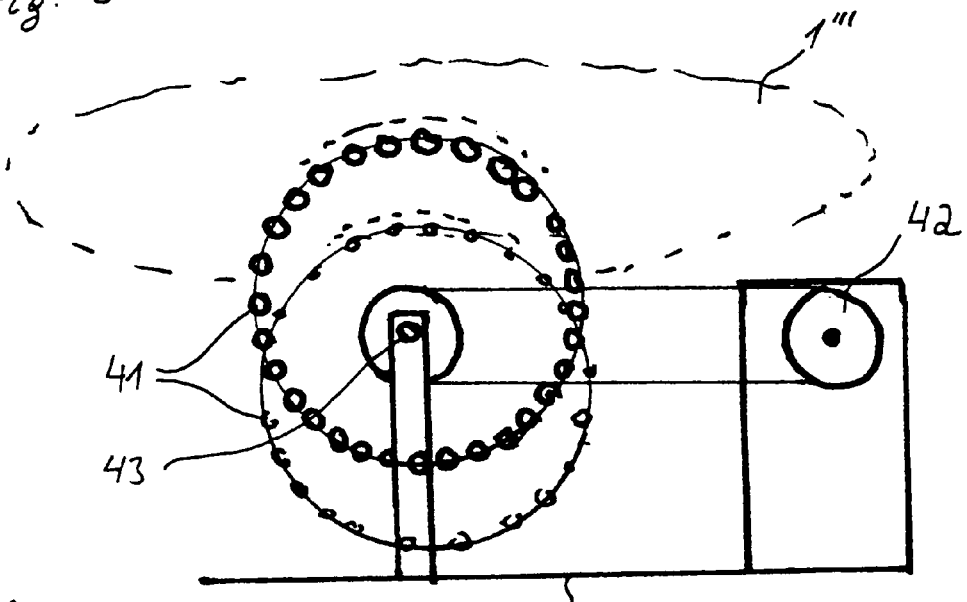
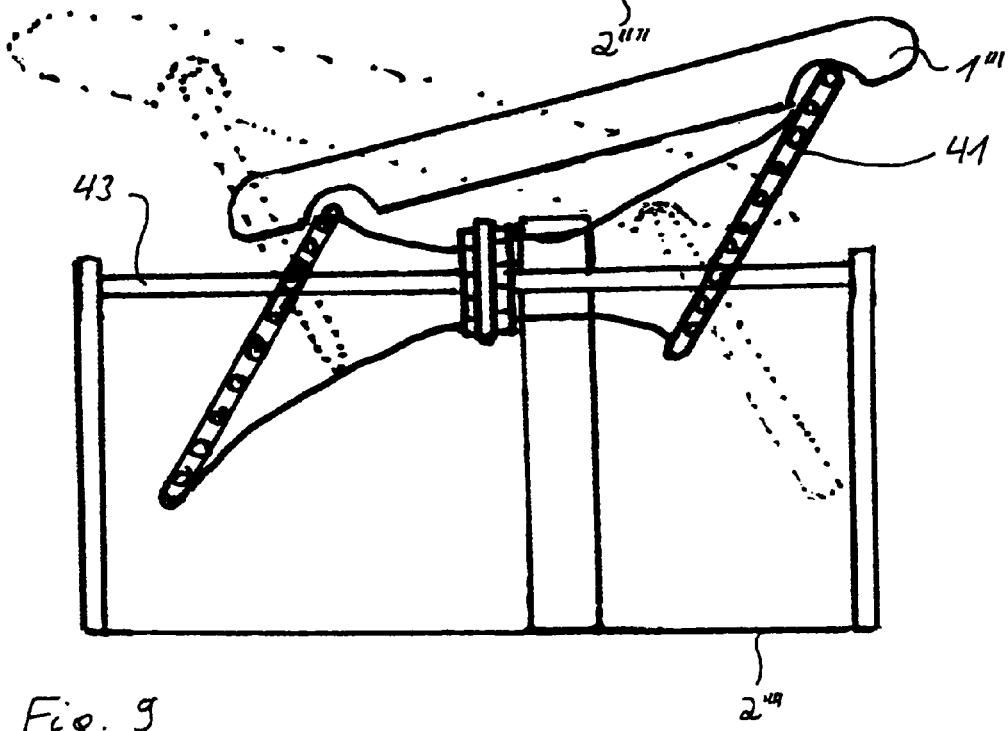
Fig. 9

SEAT

The invention relates to a seat, particularly a seat having a stable base and with a seating surface and with an upper-body support.

BACKGROUND OF THE INVENTION

Various attempts have been made to design seats that support an ergonomic sitting posture, particularly in respect of office chairs and seats for PC workstations. Accordingly, there are designs that resemble rocking-chairs, seats with knee supports and seat-balls. However, all these seats give rise to relatively tense sitting postures, since on the one hand the moving seating surface must be stabilized, and on the other, parts of the body such as the shins, cruciate ligaments and the extremities of the foot are placed under unaccustomed stress.

CROSS REFERENCE TO RELATED APPLICATIONS

There are also seats having forcibly driven seating surfaces, as are disclosed for example in German Patent No. DE 33 24 788 A1 and in European Patent Nos. EP 0 311 993 A2 and EP 0 574 073 A1. However, the seats described in these documents are relatively limited in the motion of their seating surfaces and usually only allow the seating surface to be displaced in one direction, for example up and down as in EP 0 311 993 A2 or turning from side to side as in EP 0 574 073 A1. Only the DE 33 24 788 A1 discloses a seat having a seating surface which is displaceable in two directions of motion, this being effected by lifting means that can raise the seating surface, and in this connection the seating surface can be raised and lowered in the same plane and may be tilted laterally in a circle.

Unlike the above, it is object of the present invention to create a seat with a particularly ergonomically movable seating surface.

The invention suggests a seat having the characteristics of patent claim 1.

BRIEF SUMMARY OF THE INVENTION

Unlike all known seats the body does not need to tense up to keep the seating surface in position. The muscle work that is actually desirable with all known seats as well, is assured by the fact that the body must follow the movement of the seat. In this respect, the human body has been accustomed to imitating such movement from an early age, for example from being carried by the mother, or when walking or riding. It is common knowledge that such constraining movements have a relaxing effect and may even serve therapeutic purposes. The moving seating surface is not intended to perform a vibratory movement, but instead a pleasant, gentle and even motion. Additional vibratory movements would be conceivable.

Naturally, the amplitude is adjusted to this motion in such manner that it is possible to keep the upper part of the body almost still. By continuously following the movement of the seating surface while the upper part of the body remains practically stationary, very many muscles are exercised during sitting without becoming tensed. The advantages of a seating surface having a continuous and cyclical constraining movement become apparent particularly when the seat or the seating surface are realized in such manner that they encourage, or possibly even constrain an upright sitting posture. Seating surfaces of such kind are known, for example a seating surface may be used that borrows its shape from the saddle. In particular, the seating surface may be configured such that an upright sitting posture may be assumed with a straight back and a normal curvature of the lower spine, the upper thighs being relieved of pressure.

Such an upright sitting posture may be assured with the appropriate selection of the seating surface by altering the angle of inclination of the seating surface. Such displacement may advantageously be effected in the direction of sitting as well as laterally. In particular, it is also possible to rotate the seating surface slightly relative to the horizontal. Likewise, provision may be made to displace the seating surface relative to the vertical.

Means may be provided that force at least one point of the seating surface to move continuously and cyclically in at least two directions of motion periodically, whereby the number of one period is larger, preferably twice as large, as the number of the other period. In this way, a movement resembling a walking movement may be simulated by relatively simple means, such as occurs when riding in alternating or ambling gait, or when being carried. In particular it is possible that for the execution of such movements the seating surface may be tilted accordingly.

In addition the seat may comprise a preferably stable base and a seating surface that may be shifted in its angle of inclination about a center of motion. With such an arrangement, regardless of the other characteristics of the seat, it is possible to assure not only a movement that relaxes the body during sitting, but also an ergonomically favorable body posture with respect to a workstation or a work surface. Accordingly the stable base ensures that a central position, for example in front of a monitor or a keyboard cannot be left, yet a slight movement of the body is carried out—whether voluntarily or in response to force.

In particular, it is also possible to shift the center of motion, preferably in its distance from the seating surface and/or in its distance from the base. In this way, both the change in the angle of inclination and the height of the seating surface may be influenced. The movement may also be developed in such a manner that one specific center of motion is not defined and only the inclination of the seating surface may be altered accordingly.

In particular it is also possible, to shift the center of motion depending on the displacement of the seating surface so that the course of motion for the seating surface may be selected relatively freely.

Regardless of whether the angle of inclination of the seating surface is changed freely or forcibly, the seating surface may be supported resiliently. This may be achieved for example by a spring element that acts between the mounting of the seating surface and the base thereof. It is also possible to provide a suitable resilient guide for the seating surface. Such a suspension means eliminates sharp movements that would disturb an even course of motion and lead to tension, and would also have the consequence that the compensating movement carried out subconsciously in response to the seat would become conscious suddenly and in an undesirable way and so cause distraction from a concentrated activity.

Of course, the seating surface does not have to be displaceable about a physically existing center of motion. Instead, a suitable guide may also be provided for the seating surface that shifts it about a virtual center of motion. Such a guide may be arranged for example directly underneath the seating surface itself, so that the entire base below the seating surface may be designed as a normal seat-base in known manner, possibly even with casters or the like.

In particular, this last arrangement may be realized as a footstool or a stand, instead of a seating surface, standing directly on the ground and being forced to move continuously and cyclically. Under these circumstances, of course all the patterns of motion previously described may still be realized for this footstool or stand, and similar advantages may be achieved. The seating surface according to the invention is especially suitable for office chairs. With such application a stable base provides a particularly suitable method for ensuring that a person maintains the correct posture as prescribed with respect to a work surface or a computer. In particular, the invention may also be installed in motor-vehicles, and/or in the form of car seats. Here in particular, it may successfully prevent symptoms of fatigue during long journeys. A hazard potential may be reduced by the movement being switched off in emergency situations. Likewise, a seat according to the invention may be used with train drivers' cabs and in airplanes, with the same advantages obtained. Moreover, it is possible to use a seat according to the invention as a reclining aid, if its design is of correspondingly low construction, or if it is integrated into a couch. In an application of such kind, a seat according to the invention may be effective against bedsores. A seat according to the invention may also be provided in the form of an armchair.

As has been described in the foregoing, the seating surface or footstool or stand may be moved forward and backward, up and down as well as laterally. In particular, however, tumbling gyrating motions are also possible (such as are performed for instance in a Hula or belly-dance) or tumbling vertical gyrating motions (similar to a roller-coaster). In addition, however, the seating surface may also execute a rocking, U-shaped motion in which the sides rise and fall alternately, as with a horse in gait, or a swinging motion as with an ambling camel. A movement similar to the leap of a dolphin is also possible, in which the seating surface is moved forward in an arc and then straight backward. Naturally, other movements are conceivable as well, which may be selected especially in accordance with the feeling of well-being of the user, or also for medical purposes.

In order to assure the desired movements, all known drive means, guides and transmissions may be used. Thus a desired movement may be generated for example by a sliding pin guided in a groove. However, it is also possible to drive the seating surface using an appropriate gear linkage. In particular an arrangement of angular levers may be provided by which—depending upon the precise configuration and arrangement of the angular levers—the most diverse patterns of motion can be achieved. Such an arrangement of angular levers may be constructed relatively easily, and excessive use of bearings and mountings may be avoided. Similarly, camshafts, eccentric cams or suitable, circular guides may also serve to affect the pattern of motion. By a suitable combination of transmission elements or multiple transmissions or the like, switching may also be done between various patterns of motion.

The seating surface is preferably inclined or designed such that for a person in the normal sitting position there is an angle of over 90 degrees between the upper part of the body and the thighs. This preferably applies to all operating inclinations of the seating surface and assures simple upright sitting. To this end, the seating surface may also be designed with a slightly forward tilt relative to the floor.

Leg supports that are displaceable with the sitting surface may be provided on the seat. In particular, these leg supports may include at least one lower leg support, i.e. a device for supporting the lower part of the leg. Preferably, such a lower leg support includes a surface providing lateral support. Such a lateral support surface promotes an ergonomically favorable posture and at the same time ensures that the user will remain stable on the moving seating surface. A corresponding footrest may be connected to the lower leg support.

According to wishes, these leg supports may be arranged so that they allow the user to sit sidesaddle or astride on the seat. Sitting with the legs crossed and even cross-legged with the knees moderately apart is also conceivable.

Of course such leg supports may also favorably serve to enhance a stable sitting position and thus also an ergonomically advantageous sitting posture independently of the other characteristics of the seat.

Moreover, the seat may comprise a back support, whose support surface is displaceable at least along a concave motion path independently of the seating surface. In this context, a concave motion path defines a path of motion, that is arranged around a body which is supported by the back support.

Such a back support, which is displaceable independently of the sitting surface, whose degree of freedom is preferably directed essentially perpendicularly to a vertical plane, enables the back area of a seated person to be moved comfortably within a certain range while the seating surface is stationary. On the other hand, when the seating surface is moving, the back and thus the upper part of the body can easily follow the movement of the seating surface to some degree without causing strain in the area of the lower spine.

Such a back support that is displaceable along a concave motion path is also advantageous regardless of the other characteristics of the seat. In particular, it is also possible to use this basic inventive idea as a reclining support or a headrest or even as a pillow. Here, the guide or the guidance means may be supported or located horizontally as appropriate, for example on a bed or a couch. This also presents the advantage that the head and/or the upper part of the body may be moved or turned easily without having to be lifted. In particular, such a construction may also be used as a pillow on a bed or a couch, whereby in this case the concave motion path is aligned around the head. The headrest or pillow may also include a support for the shoulders and/or back.

The back support may also be subjected to a compulsory movement and may be designed to be drivable. Moreover, the back support may be continuously adjustable, particularly with respect to inclination. This applies particularly in connection with the use of such a back support in couches and beds.

The seat may comprise arm supports, which are arranged resiliently and so as to be displaceable independently of the seating surface and/or the back support in at least the horizontal direction. In addition the suspension may be provided horizontally as well as vertically. The horizontal displacement allows a large radius to be achieved while being supported. The suspension may be used both as a comfortable support and in order to return the arm supports to an initial position. Such arm supports are also advantageous independently of the other characteristics of the seat.

The seating surface may be provided with heating and/or ventilation. Of course this also applies for a back support or the other modules of a seating device, such as headrest, arm supports, footrests or the like.

A sensor may be provided on the seat to monitor the movement of a sitting person. This may be for example a strain gauge or a dynamometer. It is also possible to merely check the power consumption of the seat drive unit. With such a sensor for monitoring the movement of the sitting person, it is possible to determine whether the sitting person "is sitting positively" or is just submitting passively to the movement of the seating surface. It is desirable that the sitting person sits positively and follows the given movement of the seat actively yet subconsciously. It can be assumed that during lazy sitting, the power the seat requires in order to execute the movement is correspondingly greater. The power consumption of the drive unit will also increase accordingly.

In addition, the seat may include means for altering the frequency and/or amplitude of the movement, so that the movement of the seat may be adapted to the way of sitting.

During positive sitting for example the frequency and/or amplitude of the movement may be reduced to a minimum. On the other hand, when the sitting person starts to sit "lazily", the amplitude and/or frequency may be changed accordingly, in order thereby to stimulate positive sitting. Additionally, a signal may sound when lazy sitting is detected, such as a beep, or music. With such an arrangement it is possible especially in airplane or car-seats or in train drivers' cabs to reduce the danger of falling asleep, since a transition from positive sitting to lazy occurs when a person falls asleep.

Such a seat is also suitable for therapeutic purposes. Particularly in this connection, a drive unit with single linear actuators offset against each other may be provided. This offset arrangement may be realized for example such as is known in flight simulators. Particularly servo-drives or pneumatic or hydraulic drives may be used as driving means. In this connection the seat may particularly serve for the remobilization of persons after surgery of the lower extremities, for the strengthening the back and pelvic musculature and for a variable, flexible and thus evenly distributed load on disks of the spine and in support of digestion for totally and partially paralyzed persons or for therapy for autistic or hyperactive persons.

BRIEF DESCRIPTION OF SEVERAL VIEWS OF THE DRAWINGS

Further advantages, objects and properties of the present invention will be explained in the following description of attached drawing, in which several exemplary embodiments of a seat according to the invention are represented. In the drawing:

FIG. 1 is a schematic sectional view of a first seat having a seating surface according to the invention and means for supporting the upper body, wherein

FIG. 8 is a schematic sectional view of a fifth seat having a sitting surface according to the invention, FIG. 9 is a lengthwise schematic section of the seat according to FIG. 8.

DETAILED DESCRIPTION OF THE INVENTION

Figure 1A:
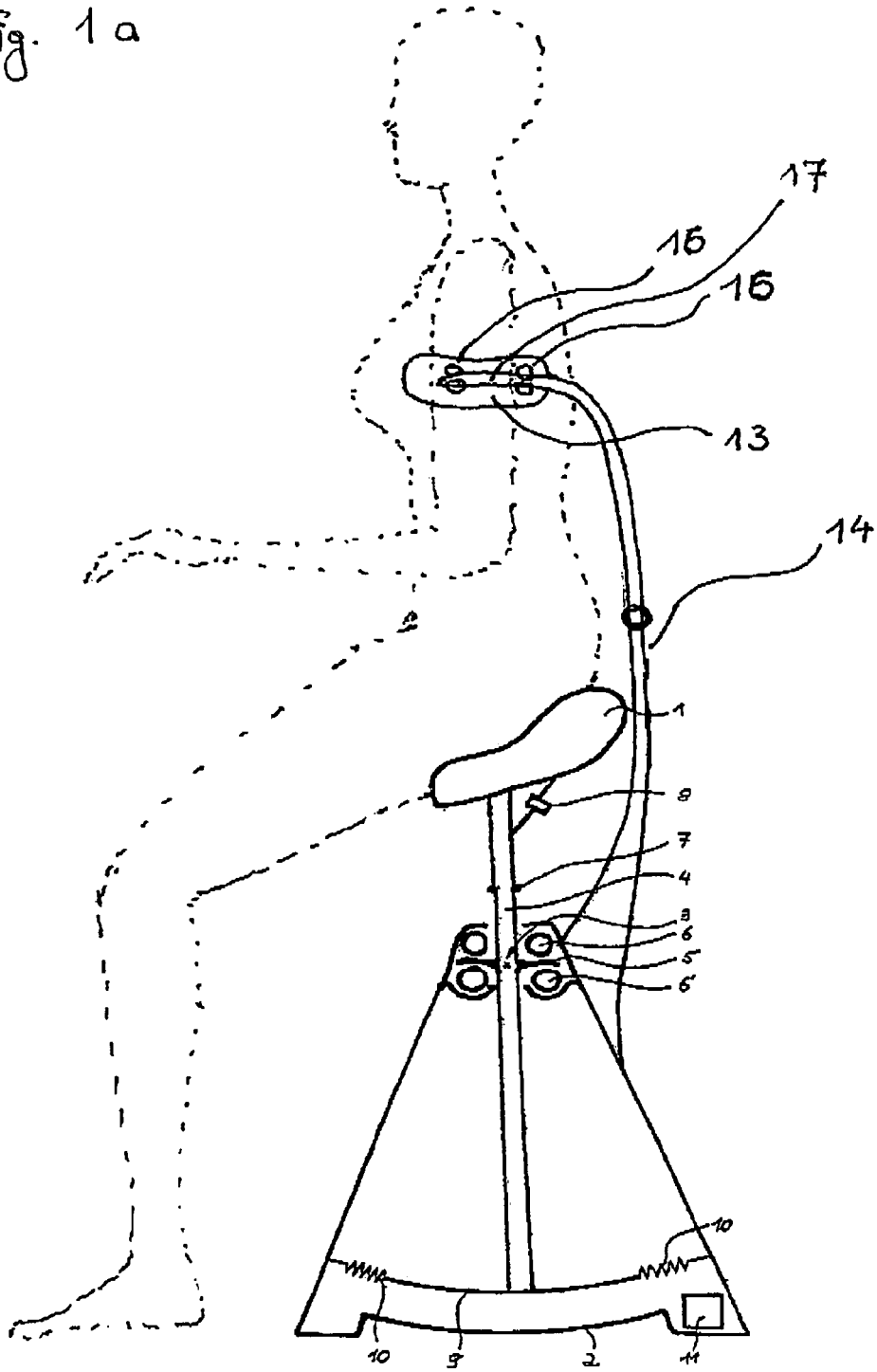
FIG. 1*a* shows means for supporting the upper body in the form of supports engaging under the arm pits.

In the seat shown in FIG. 1, a seating surface 1 is displaceable in its angle of inclination about a center of motion 3 provided between a stable seat base 2 and seating surface 1. This is assured by the fact that a support rod 4, to which seating surface 1 is rigidly attached, is supported at the base 2 by means of a supporting disk 5.

Moreover supporting disk 5 is movably attached to base 2, so that the seating surface is suitably displaceable, both in sitting direction and laterally.

Supporting disk 5 is supported at the base 2 by means of two elastic rings 6' and 6", wherein supporting disk 5 is supported on lower elastic ring 6' and is secured from above by second elastic ring 6". As may be seen directly, this arrangement is already sufficient to create a seating surface 1 that is displaceable in a manner according to the invention, which provides an upright rest position.

Additionally, support rod 4 includes a height adjustment 7 and a tilt adjustment 8, so that the seat may be adapted to individual needs.

As is evident from FIG. 1, support rod 4 might also be rigidly connected to base 2 if an appropriate motion mechanism is provided directly under seating surface 1, that enables displacement about the then virtual center of motion 3.

With the embodiment in FIG. 1, a counter-plate 9 is provided at the end of support rod 4 that is opposite seating surface 1. The dead weight of this counter-plate 9 serves as a damping element, so that the seating surface 1 is not too easily displaceable. In addition, spring elements 10 are provided on counter-plate 9, which not only serve to damp vibration in support of elastic rings 6' and 6" but also to prevent seating surface 1 from rotating about support rod 4.

While the components described so far ensure free displacement of seating surface 1 about the center of motion 3, the embodiment in FIG. 1 furthermore includes a drive 11, which is effectively connected to counter-plate 9 via an eccentric gear. Here, the gear is selected such that the seating surface executes a U-shaped side-to-side rocking movement.

As is directly evident, it is also possible to mount the support rod 4 at the bottom of base 2 and support it movably in supporting disk 5. By contouring the bottom of base 2, a U-shaped side-to-side, alternating, up-and-down movement may be achieved, as with a horse in gait.

In this case seating surface 1 is selected in such a manner that it constrains an upright posture with a straight back and a normal curvature of the lower spine, wherein the thighs are relieved of pressure. This upright posture together with the passive following of the active compulsory movement respectively an appropriate compensating movement give the sitting person a feeling of security without having a soporific effect, counteract muscle tension and improve blood circulation throughout the entire body as well as improving digestion. The well sprung motion causes a soft and gentle, varying load on the disks of the spine. Here, the amplitude of the movement is selected such that the head, shoulders and upper part of the body can easily be kept still.

A U-shaped side-to-side alternating movement is advantageous particularly in connection with a rigid back support, since with such a movement the buttocks are moved away from the back support with each change of side, so that a movement of the buttocks conditioned hereby, as well as the respective subsequent movement of the back reduces friction on the backrest and does not cause stress or tension with the back support. This is significant especially for its use in car seats, airplane seats or train drivers' cabs.

Figure 1B:
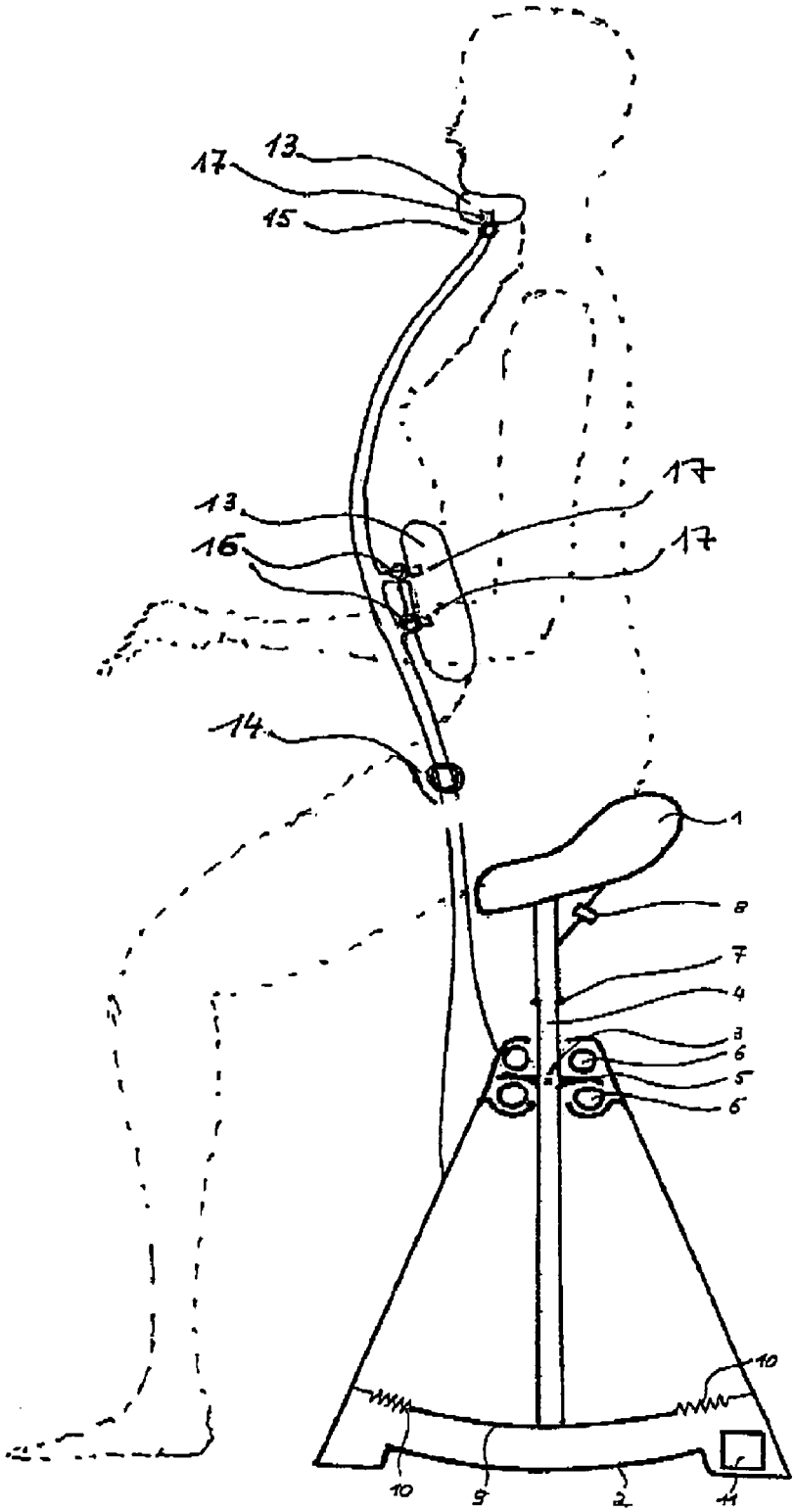
FIG. 1*b* shows means for supporting the upper body in the form of a stomach support and chin support.
Figure 1C:
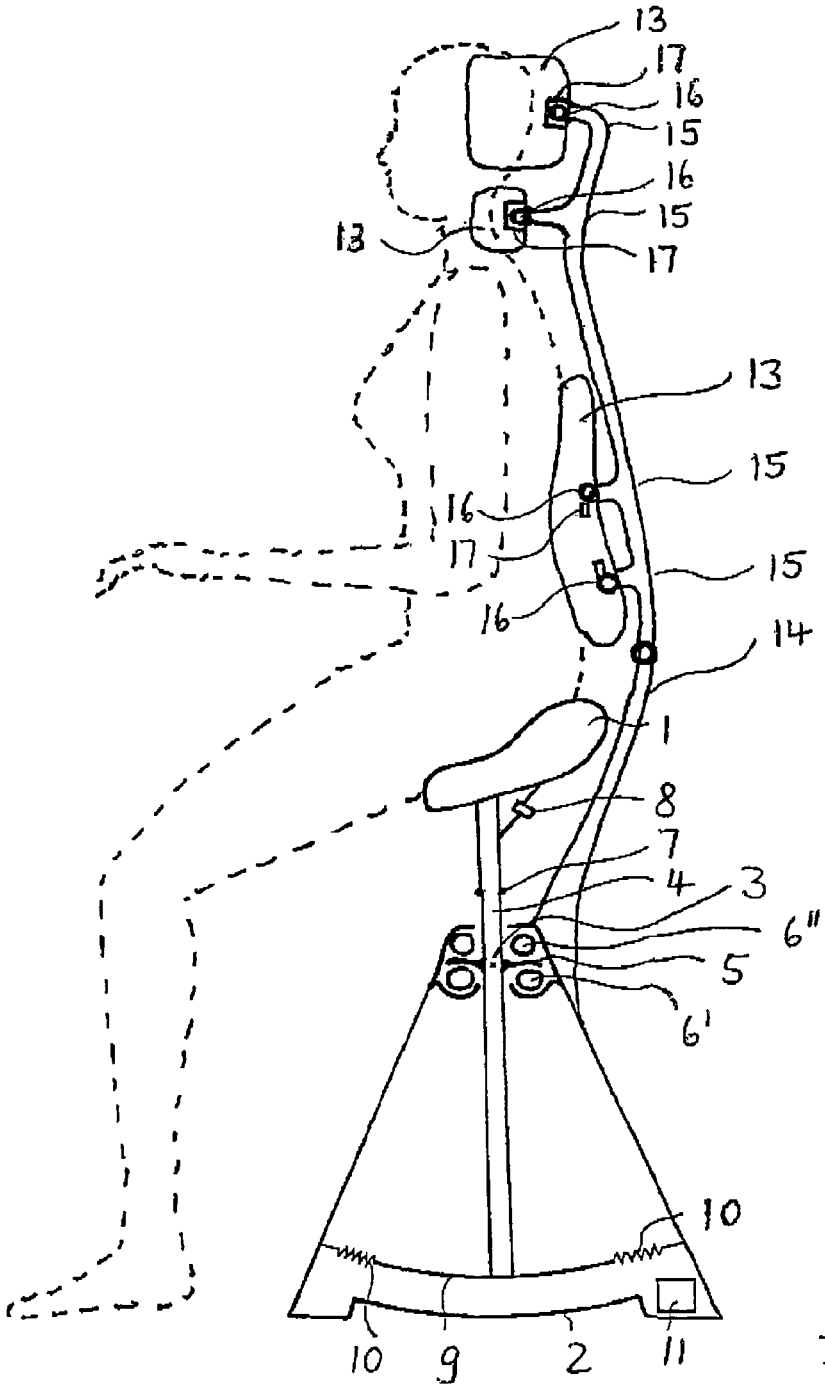
FIG. 1*c* shows a headrest and a neckrest.
Figure 2:
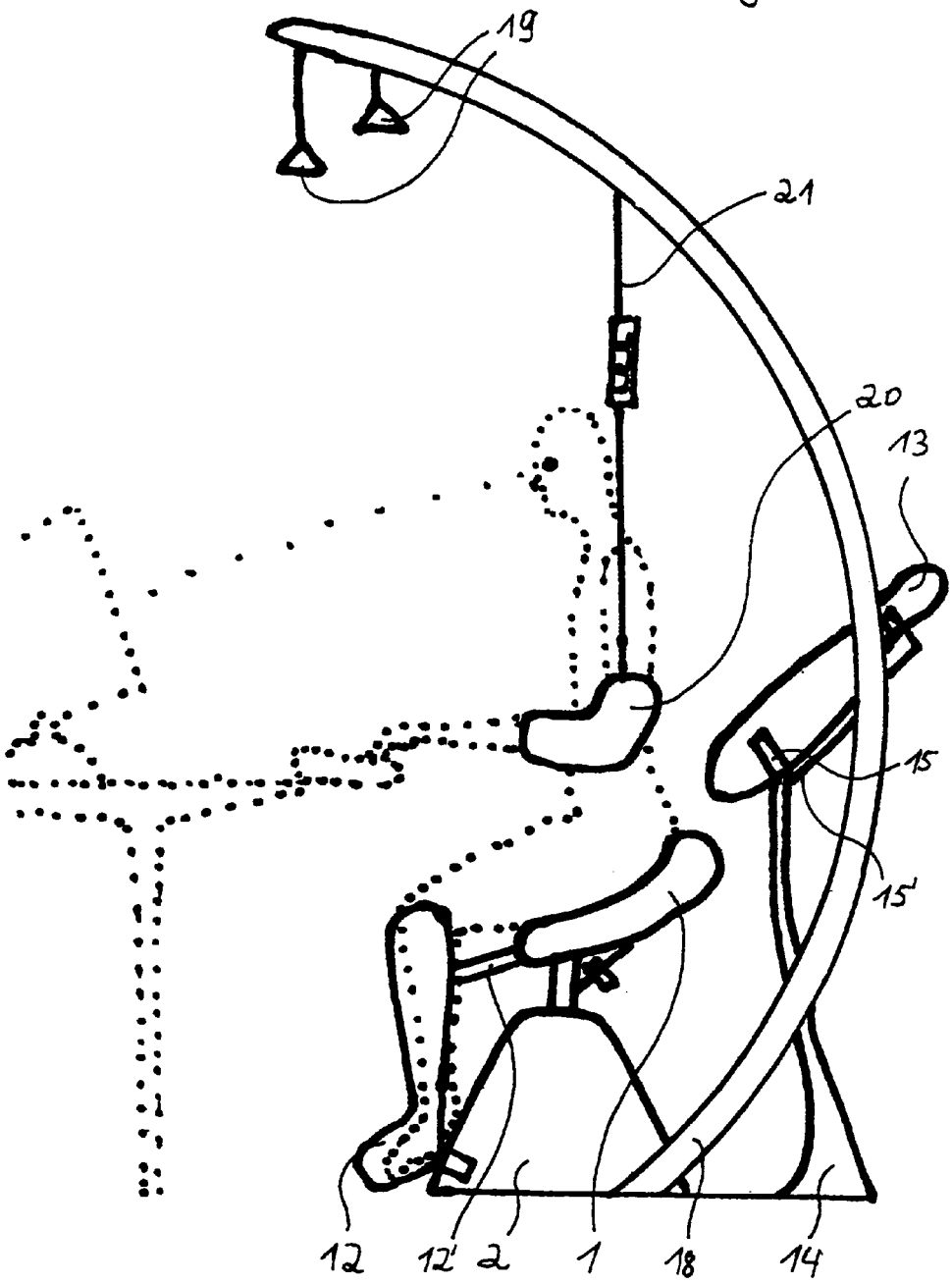
FIG. 2 is a schematic side view of a second seat having a sitting surface according to the invention.
Figure 3:
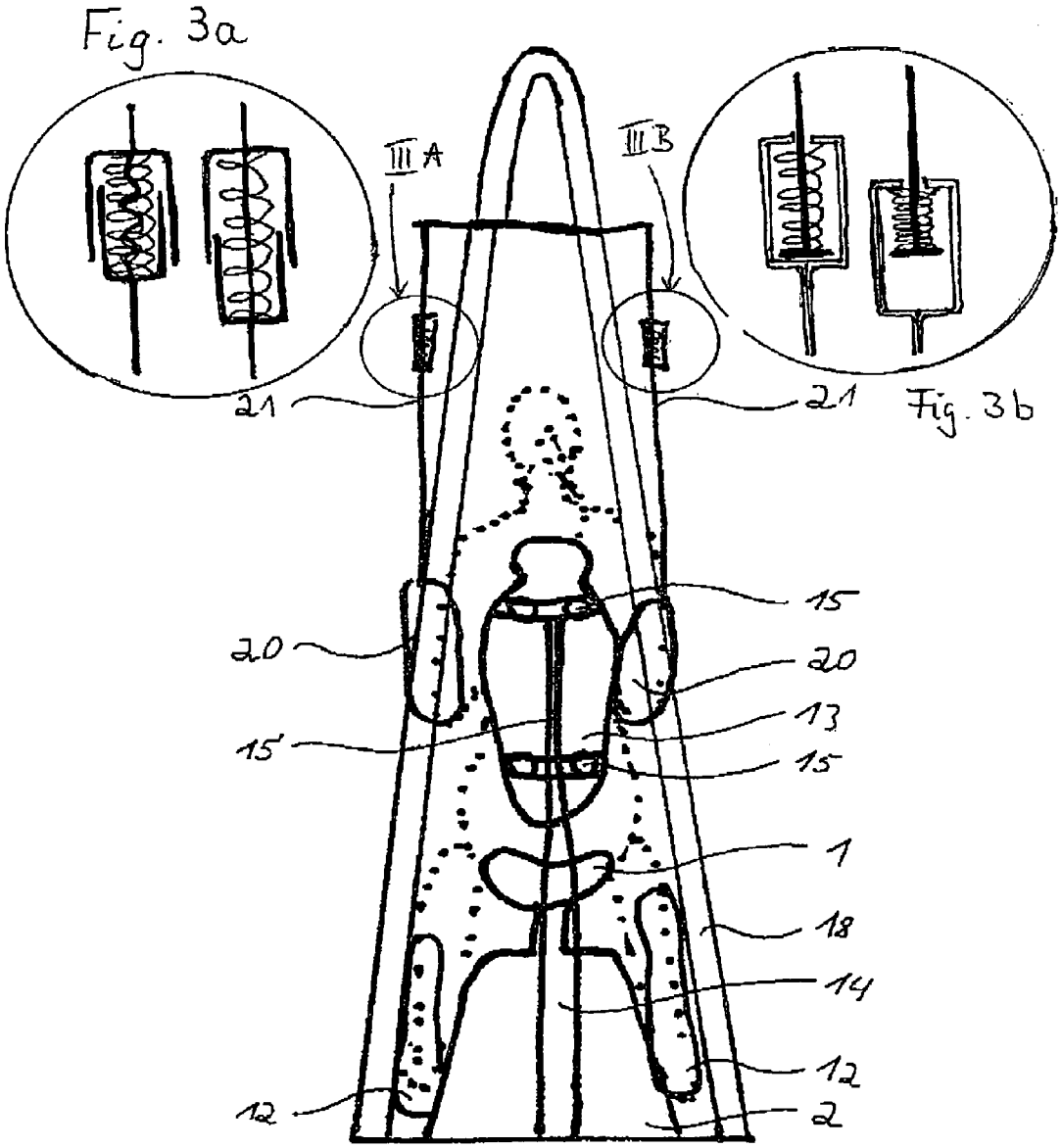
FIG. 3 is the seat of FIG. 2 in back view.

The seat shown in FIGS. 2 and 3 is essentially similar to the seat in FIG. 1. However, in the former, two lower leg supports 12 are also provided at seating surface 1, and are fastened to seating surface 1 by means of mounting devices 12'. On one hand, lower leg supports 12 are equipped with laterally supporting outwardly directed supporting surfaces, which enable a sitting position similar to that of a horseman. Moreover, supports 12 also include one footrest each, so that the entire lower body can follow the moving seating surface 1, while with the embodiment depicted in FIG. 1 the feet rest on the ground.

By means of mounting devices 12' supports 12 may also be adjusted in such a manner that a sitting position similar to a lady's sidesaddle or cross-legged with knees moderately apart is possible.

Figure 4:
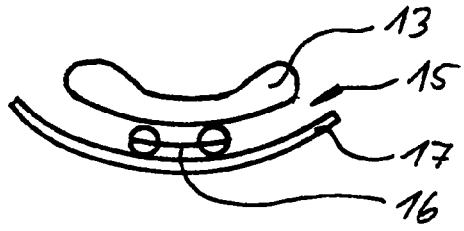
FIG. 4 is a schematic representation of the drive mechanism of the back support of the seat according to FIGS. 2 and 3 or of a headrest.

In addition, the seat according to FIGS. 2 and 3 comprises a back support, whose supporting surface 13 may be displaced on a concave motion path independently of seating surface 1. For this, the back support is immovably secured with respect to base 2 of the seat by means of a base 14, and supporting surface 13 may be displaced over a guide 15 relative to base 14. As is clear in particular from FIG. 4, guide 15 includes a concave curved guidebar 17, along which a carriage 16 travels with supporting surfaces 13. As may also be understood from this figure, the term "concave motion path" refers to the supporting surface 13 and/or to a body resting on this supporting surface. A construction as shown in FIG. 4 may also be used as a shoulder, neck, or headrest and/or as a pillow. In particular, a combination of head, neck, shoulder, and/or back support is conceivable. Here, the form of the supporting surface is adapted to the head movement and/or a body movement and the guidebar is suitably supported.

Accordingly, the supporting surface may be designed substantially thicker at the sides in the head region, so that when the body turns, the head is supported in comfortable position relative to that shoulder then located therebelow.

Supporting surface 13 of the back support may also be displaced resiliently along a diagonal guide 15', so that if need be the back support or supporting surface 13 can follow the movement of the seating surface.

In addition, the seat according to FIGS. 2 and 3 is furnished with a supporting lever 18, to which lighting fixtures 19 as well as forearm supports 20 are attached. The lighting fixtures are positioned in such a manner that a person sitting in this seat at a computer workstation (indicated by dotted line) is not dazzled.

Arm supports 20 are conformed as angled half shells and are attached resiliently to supporting lever 18 by means of suspensions 21. Here, the distance between suspensions 21 as they are attached to supporting lever 18 is wider than shoulder width. In this way, supports 20 do not get in the way when they are not in use. Furthermore, supports 20 are suspended resiliently, wherein a pressure- and/or speed-dependent locking system is provided, so that armrest 20 may be used as a support for rising out of the seat, if it is loaded suddenly.

As is shown in FIG. 2, the person in a resting position may rest against supporting surface 13 of the back support, and the seating surface may be brought into a neutral position at the same time. In particular it is possible in this rest position to leave the arms in forearm supports 20 so that they remain in a relaxed position while the person is resting. Remaining in the forearm support ensures that even circulation of the blood throughout the body is maintained, particularly preventing the accumulation of too much blood in the arms.

Of course, such resilient arm supports may also be positioned resiliently from below or from the rear or the front, and may also advantageous independently of the other characteristics of the seat and/or chair.

Here the long suspensions 21 provide a large area, within which the arms are supported and freely movable. With this, neck tension may be avoided effectively.

The seat may also include a lumbar support and/or a neck support, which—optionally—may be securely attached to seating surface 1 or may be fashioned independently of this seating surface 1. In particular, these may also be displaceable along a concave motion path, similarly to the back support.

Figure 5:
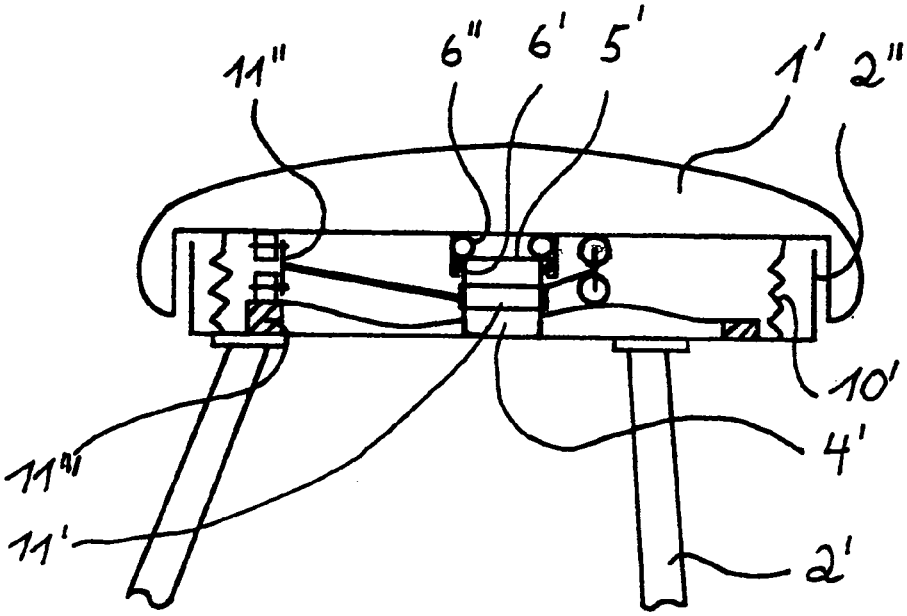
FIG. 5 is a schematic sectional view of a third seat having a sitting surface according to the invention.

In the seat shown in FIG. 5, the necessary mechanisms for the movement of seating surface 1' are positioned directly under the same in a housing 2" supported on three legs 2'. Here, seating surface 1' is pivotably mounted on a support 4' by means of two elastic rings 6' and 6" and several supporting springs 10'. A corresponding holder of seating surface 1' surrounds a support plate 5' at support 4', above or below which the elastic rings 6' and/or 6" are arranged. In this way, the seat may be raised or displaced at its seating surface 1', but the mobility according to the invention is preserved. Supporting springs 10' here are also used to reset the seating surface in the event of unintended rotation of the same.

Elastic rings 6', 6" might also be realized by an elastic ring or a tube encircling the outer circumferential area.

In the embodiment shown in FIG. 5, the constraining movement of seating surface 1' according to the invention is assured by a driven cam 11', which rotates around support 4' and drives spacers 11", that rotate on a guideway 11'" with the cam 11'. Guide 11'" is shaped in such manner that a desired modification of the angle of inclination is achieved.

As is also directly evident from FIG. 5, a central supporting base may be used instead of the supports 2', as for a known office chair. It is also possible to dispense entirely with supports 2' and to arrange the arrangement on the ground or on a normal seat. When arranged on the ground or on a low stool, this arrangement may serve as an underlay for standing, particularly during standing activities at machines and the like, or also as a footstool. In particular it is also possible to combine such a footstool with the seats as shown in FIGS. 1 to 3.

The embodiment shown in FIG. 5 is also particularly suitable for a seat/standing seat combination, in which the seating surface is moved from a sitting position into a semi-standing position of the user by means of a gas spring or similar lifting devices. In the sitting position, a person may then assume a position for written work or the like, while the semi-standing position is used for activities that may also be carried out while standing. The semi-standing position may be provided offset from the sitting position so that in particular semi-standing is easily possible without obstruction by a footstool or a low work-surface.

By substituting the drive components, particularly guideway 11''', different patterns of motion may be realized in a particularly simple way with the configuration according to FIG. 5. Similarly, another kind of drive may also be conceivable. In particular, a drive comprising linear drives offset against other may be used, such as are used for example in flight simulators.

The seats shown in FIGS. 6 to 9 also have a seating surface 1" or 1''', which is displaceable about a center of motion. However, this center of motion is shifted continuously with the movement of seating surface 1" or 1''', so that the complex movement is better described in general terms.

Figure 6:
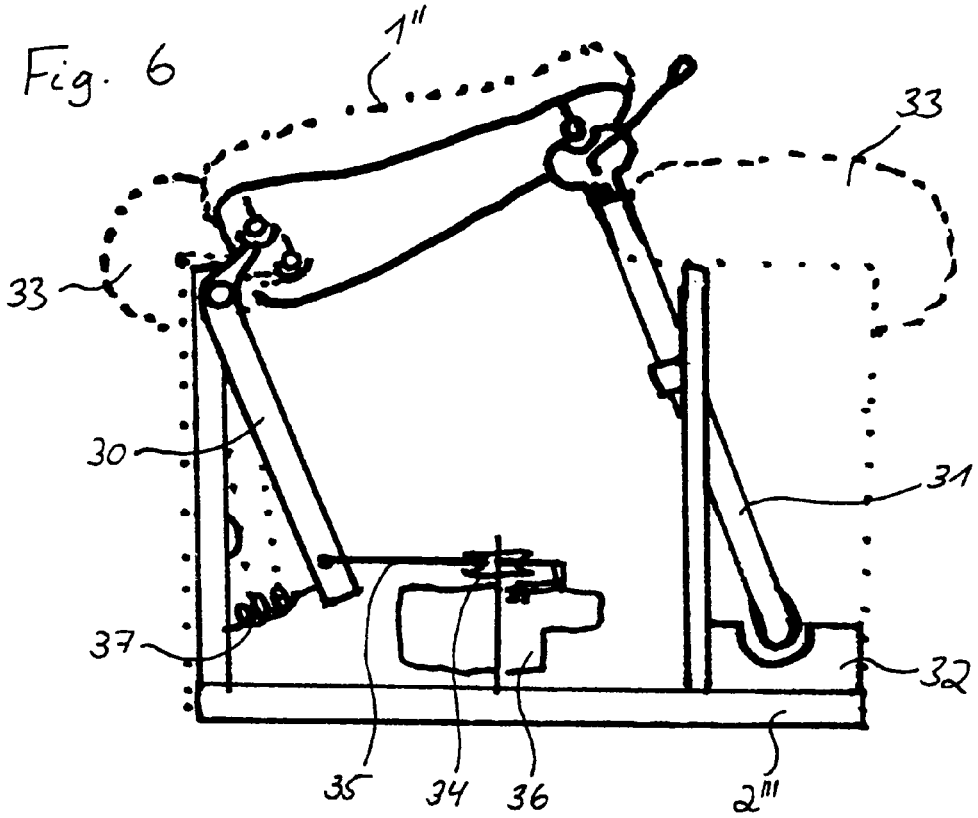
FIG. 6 is a schematic sectional view of a fourth seat having a sitting surface according to the invention.
Figure 7:
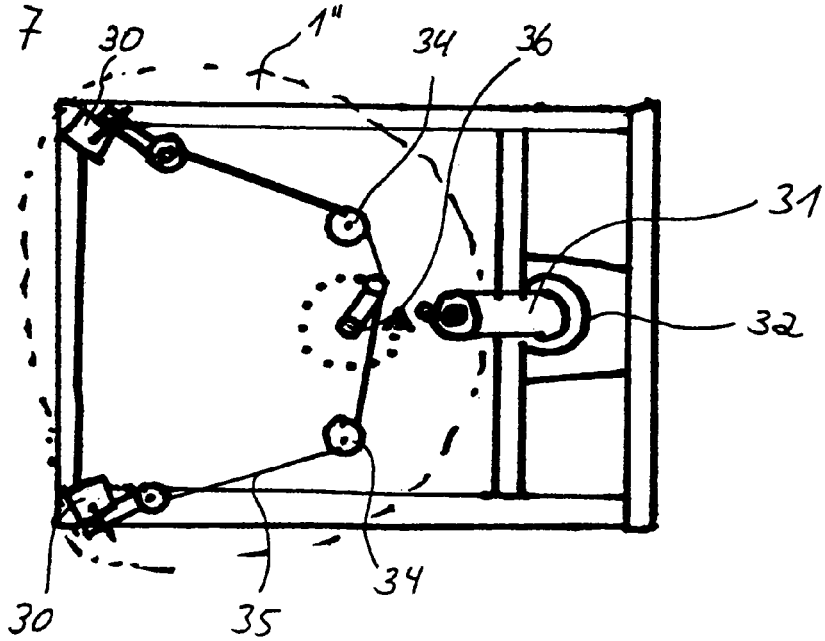
FIG. 7 is a schematic horizontal section of the seat according to FIG. 6

While the movement of seating surface 1" in the embodiment shown in FIGS. 6 and 7 most closely resembles the movement of a saddle on horseback, the movement of seating surface 1''' in the embodiment as shown in FIGS. 8 and 9 is more like the movement of a saddle on an ambler.

Both seats are characterized by a seating surface that is constrained to move continuously and cyclically, wherein means are provided that shift a center of motion corresponding to the movement of the seating surface. All known seats and/or devices according to prior art however have a fixed center of motion, which may be displaced with respect to height as necessary by relockable control members, whereas the center of motion itself remains in place during the rotary motion.

In addition, both seats include means that force at least one point of seating surface 1" or 1''' to move continuously and cyclically in at least two directions of motion periodically, wherein the number of periods in one direction of motion is larger than the number of periods in the other direction of motion. Preferably, one number of periods is exactly twice as large as the number of the other period. Thus a rocking or swinging motion may be achieved, as is ultimately realized with the exemplary embodiment shown in FIGS. 6 to 9.

In order to realize this, the embodiment shown in FIGS. 6 and 7 comprises two rocker arms 30 on base 2''', each of which supports sitting surface 1" via a ball joint. Seating surface 1" is further supported by means of a support 31, likewise via a ball joint. Support 31 includes a gas pressure spring for height adjustment as well as for increasing sitting comfort and is supported in a ball cup 32 preferably made from nylon or a similar anti-friction material.

For improved comfort, the seat further includes additional upholstery 33, which is rigidly connected with base 2'''.

The rocker arms are driven by a Bowden cable 35 passed through reels 34, which is constrained to move continuously and cyclically by a motor 36, as well as by return motion springs 37. By the cyclic raising of the toggle joints, seating surface 1" is shifted on the one hand at a certain frequency from right to left, wherein the exact position of seating surface 1" is determined by the geometry of rocker arms 30 and support 31. At the same time, as is directly evident, seating surface 1" is also displaced with double frequency backwards and forwards respectively up and down. In this way a rocking motion results similar to that of the saddle on a horse, which has an extremely calming, even therapeutic effect.

Of course other joints, such as for example toggle joints with sufficient play, or sufficiently rigid springs may be used instead of the ball and socket joints.

In contrast, the construction of the embodiment shown in FIGS. 8 and 9 includes two rigidly connected ball bearing disks 41, which are arranged eccentrically and at an angle of inclination and are located underneath seating surface 1''' so as to support it. Ball bearing disks 41 are driven in rotary manner by a drive 42 and are mounted on a shaft 43. In addition, seating surface 1''', is secured against inadvertent tipping by a guide, which is not shown.

By the rotation of ball bearing disks 41, seating surface 1''' is stimulated into a rocking movement, which resembles for instance the motion of a saddle on an ambler. Here, seating surface 1''' moves from one side to the other with every half revolution of ball bearing disks 41 as shown in FIG. 9. At the same time, seating surface 1''' wobbles during this movement because of the twisted position created by the eccentricity of ball bearing disks 41, as is shown particularly in FIG. 8. This wobbling motion shows the double frequency of the lateral motion.

Instead of the mechanical arrangements shown, other drive units may also be used. Particularly means that displace the center of motion depending on the movement of the seating surface, or means that force at least one point of seating surface 1" or 1''' to move continuously and cyclically in at least two directions of motion periodically, may further include control devices such as electrical or electronic controls, and corresponding driven actuators or other driving means for the seating surface and its angle of inclination.

Figure 10:
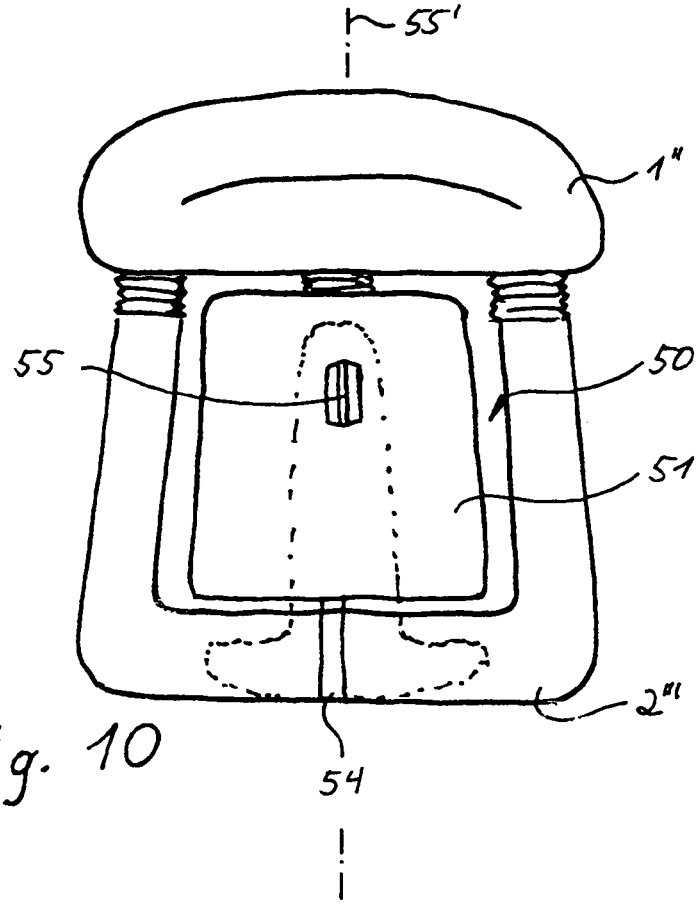
FIG. 10 is a schematic front view of a sixth seat similar to FIGS. 6 and 7 with leg-rest.
Figure 11:
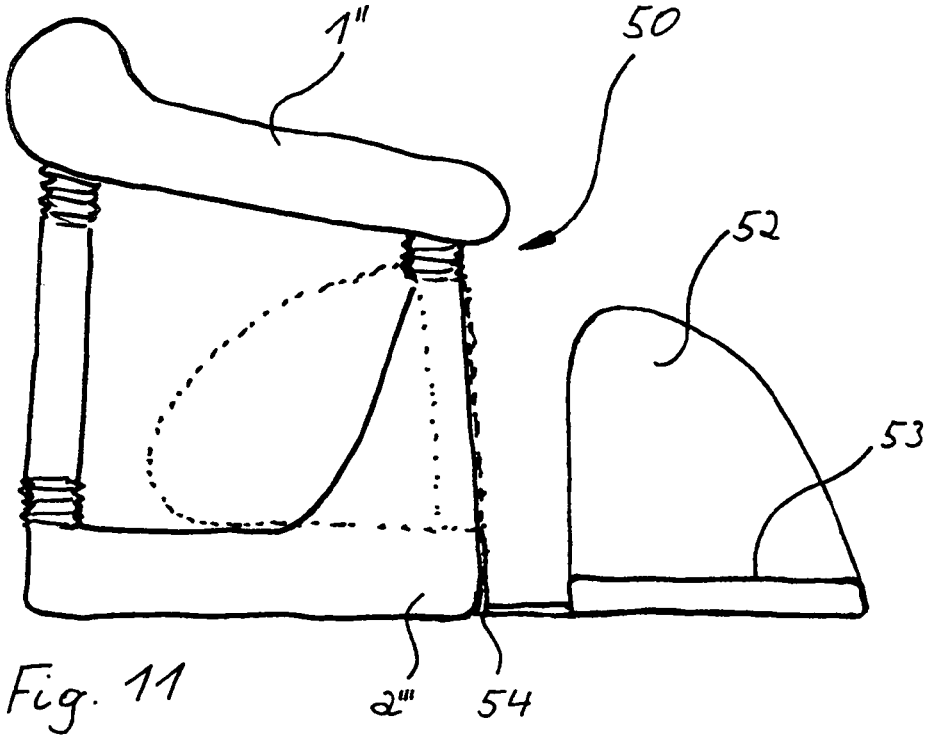
FIG. 11 is a side view of the seat according to FIG. 10 with leg-rest folded out.
Figure 12:
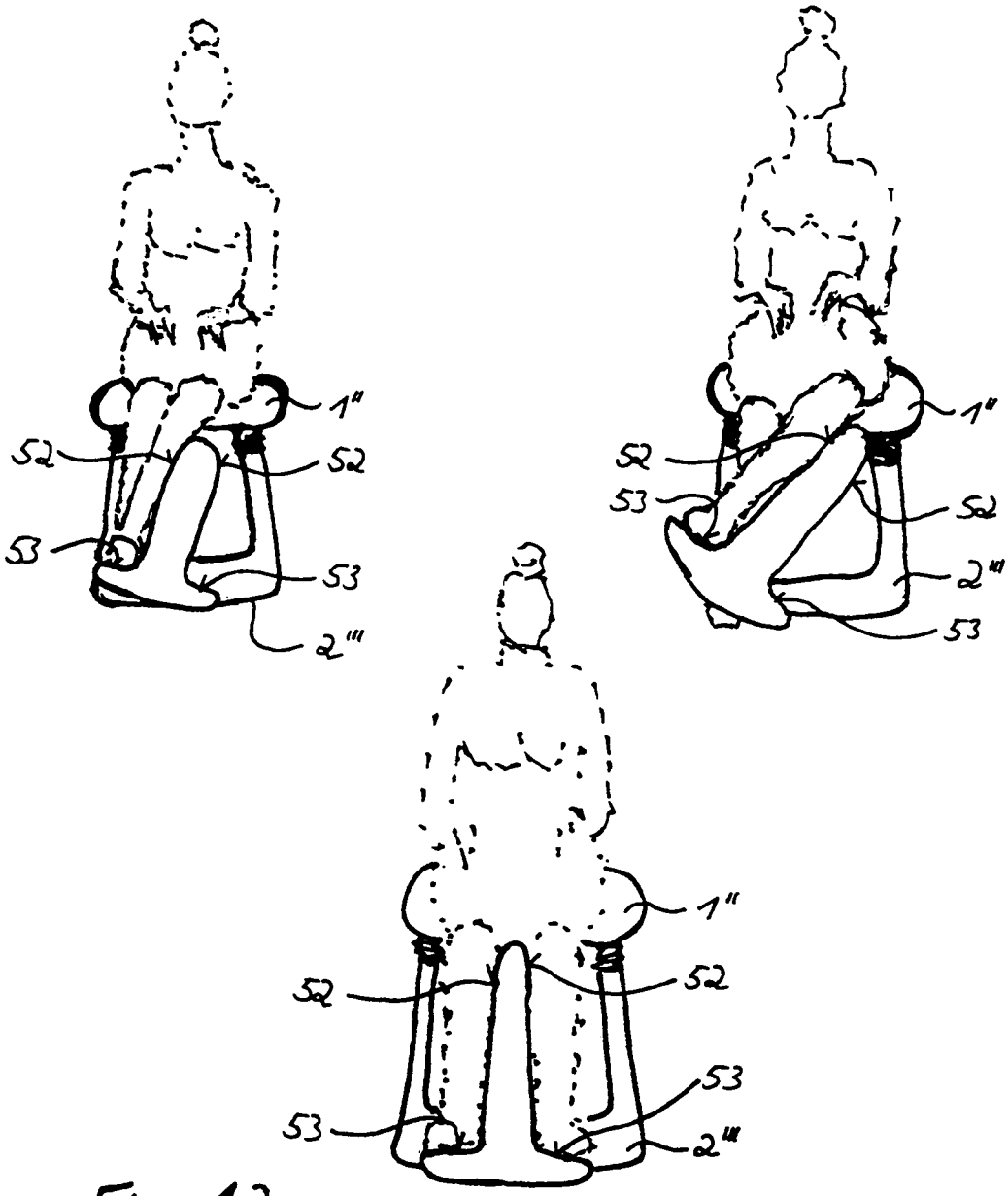
FIG. 12 shows various sitting positions on the seat according to FIGS. 10 and 11.
Figure 13:
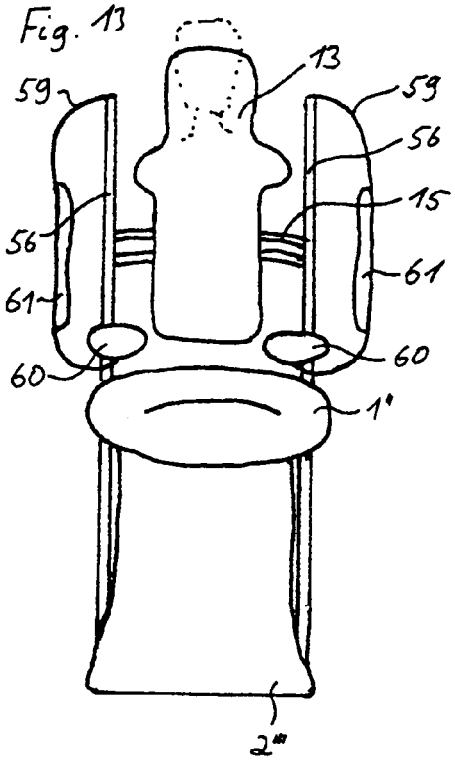
FIG. 13 is a front view of a seventh seat similar to the one according to FIGS. 6 and 7 with back support and arm supports, wherein the arm supports are in a writing position.
Figure 15:
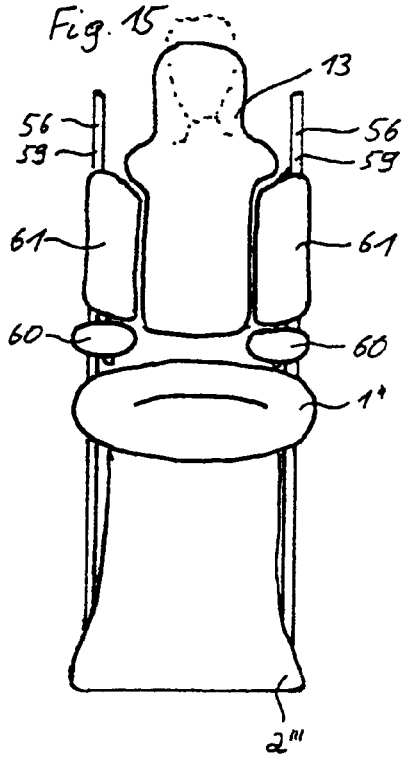
FIG. 15 shows the seat according to FIGS. 13 and 14 in a position similar to FIG. 13, wherein the arm supports and a back support are in a rest position.
Figure 14:
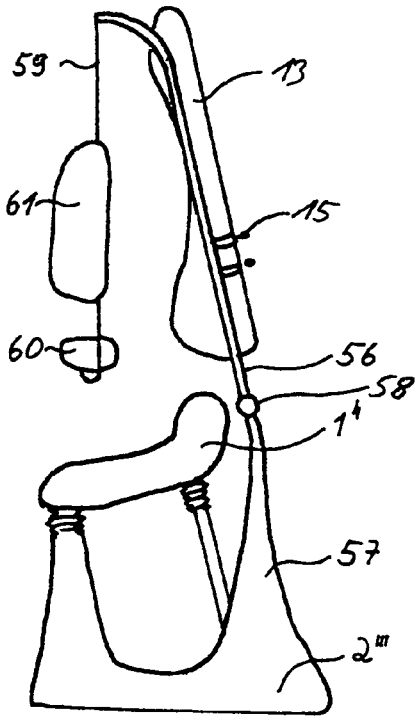
FIG. 14 is a side view of the seat according to FIG. 13.
Figure 16:
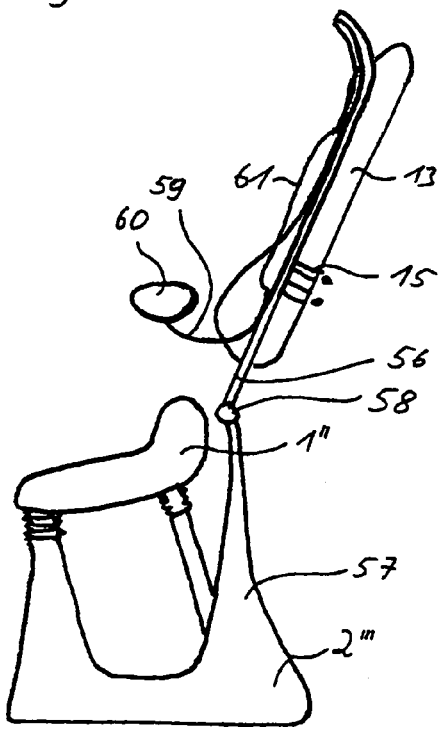
FIG. 16 is a side view of the seat according to FIG. 15.

The embodiment shown in FIGS. 10 to 12 corresponds essentially with that shown in FIGS. 6 and 7. Here too, a seat is provided with a seating surface 1" that is tilted slightly forward and executes a movement, which essentially resembles a riding movement. This movement may be assured by an arrangement corresponding to an arrangement according to FIGS. 6 and 7.

In addition, this seat comprises a recess 50, in which a leg-rest/footrest 51 is stored. The leg-rest/footrest includes at least one upper support surface 52 for supporting one or both lower legs, and at least one lower support surface 53 as a footrest, as is shown particularly in FIG. 12. With this specific embodiment, a lower and an upper support surface 53, 52 is provided for each leg. As is shown in the present embodiment, the upper support surface 52 may be positioned, at least in part, at an angle relative to lower support surface 53.

As is shown particularly in FIGS. 10 and 12 leg-rest/footrest 51 includes a mirror plane 55' (shown in FIG. 10). In this mirror plane 55' leg-rest/footrest 51 is movable relative to seat base 2''' and seating surface 1", and—if desired—may be locked at an angled position (see FIG. 12). This may be effected for example by a rod that is arranged inside leg-rest/footrest 51, and which is positioned on the ground and on which the actual leg-rest/footrest 51 is lockably mounted. However, other mounting plates and guides are also conceivable for leg-rest/footrest 51. If required, means to move leg-rest/footrest 51 in another direction may also be provided.

As may be seen, only one leg-rest/footrest 51 is provided with this seat, and it is suitable for both legs. However a leg-rest/footrest may also be provided, which supports only one leg and/or one foot. This may be for example a leg support in a vehicle, which supports only the leg of the accelerator foot.

This support then contacts the leg appropriately from the outside.

In this embodiment, leg-rest/footrest 51 is connected to the seat by connecting means 54, which enable leg-rest/footrest 51 to be folded into or out of recess 50. On the other hand it is also conceivable that leg-rest/footrest 51 may be arranged separately from the seat. Similarly, connecting means 54 may permit another type of relative motion between leg-rest/footrest and the rest of the seat, such as displacement or the like.

In order to facilitate folding out leg-rest/footrest 51 a handle 55 is provided on the underside thereof, as is shown in FIG. 10.

The seat shown in FIGS. 13 to 16 is also essentially the same as the seat shown in FIGS. 6 and 7. However, in the seat depicted in FIGS. 13 to 16, a back support 13 is provided that is displaceable along a concave guideway 15. Guideway 15 is fastened to support levers 56, which are connected to base 2''' at a cantilever 57 of base 2''' via an articulated joint 58. Optionally, means for locking the back support and/or stops may be provided, which limit its movement. In addition, back support 13 may also be arranged to pivot about a center of motion provided on a level with guide 15. Naturally, such an arrangement of the back support is also advantageous independently of the other characteristics of the seat.

Further, spring levers 59 are provided at the upper ends of support levers 56, to which upper arm supports 61 and lower arm supports 60 are attached. Spring levers 59 are displaceable together with back support 13 between a writing position (see FIGS. 13 and 14) and a rest position (see FIGS. 15 and 16).

In the writing position, back support 13 is tilted forward and supports the back only slightly, wherein by the U-shaped movement the buttocks of a sitting person are moved somewhat forward during a lateral movement, so that specifically strain of the back area due to the relative motion between back and back support 13 would be avoided even if back support 13 were rigidly arranged, as for example in a motor vehicle. However because of the concave motion path of the back support this has no effect with this seat.

In addition, spring levers 59 are outwardly curved in the writing position and surround the arms and the arm supports 60 from the outside. Because of the suspension, the person may still move the arms to different positions without leaving the arm supports, so that the supporting function is maintained.

In the rest position, the spring levers 59 are rotated about a center of motion on upper supporting levers 56 and are supported thereon. As a result, the spring travel is shortened, so that the arm supports 60 are supported more rigidly. In this way they can be used as supports for standing up.

Moreover, arm supports 60 are then located in a position for use, and a person may recline comfortably and relaxed. Of course, such a separate arrangement of arm supports 60 may be advantageous independently of seating surface 1" and back support 13. This also applies in particular to the centers of motion provided above the shoulders of a sitting person and to the arrangement of arm supports 60 with a defined range of movement in a writing position.

On this seat, a headrest may also be provided. It is preferably not directly connected to the back support, but separately fastened to the seat in an appropriate way. Likewise lateral supports may also be provided that support under the armpits, and/or a stomach-/or a lumbar support and/or a chin and/or neck-support. The stomach support and/or lumbar support may be implemented displaceably with a concave path of motion similarly to the backrest. In this regard, FIG. 1*a* shows a supporting surface 13 for the armpits that is mounted on a carriage 16 that may be displaced relative to base 14 on concave curved guidebar 17 of a guide 15, as disclosed in connection with the backrest. FIG. 1*b* shows supporting surfaces 13 for the chin and the stomach mounted on carriages 16 displaceable relative to base 14 on guidebars 17. FIG. 1*c* shows supporting surfaces 13 mounted on a a carriage 16 and forming a neckrest and a headrest, respectively; the supporting surfaces may be displaced relative to base 14 on concave curved guidebar 17 of a guide 15, as disclosed in connection with the backrest. The basic seat configuration of FIGS. 1,1*a*, 1*b*, and 1*c* is identical. Same parts that function in the same way are identified with same reference numerals.

We claim:

1. A seating device comprising:

a base;

means for supporting an upper body of a person, wherein said means for supporting is connected to said base;

driving means connected to said base;

a seating surface connected to said driving means;

said driving means driving said seating surface so that at least one point of said seating surface is forced to perform a periodic, continuous and cyclical movement in at least two directions of motion, wherein said periodic, continuous and cyclical movement comprises a first period of motion and a second period of motion, wherein a number of said first period of motion is larger than a number of said second period of motion;

wherein said seating surface is not directly connected to said means for supporting and moves independently of said means for supporting and independently of said base.

2. A seating device as in claim 1 wherein said means for supporting the upper body comprise at least one supporting device resiliently mounted thereto.

3. A seating device as in claim 2 wherein said at least one supporting device is displaceable over a guide on a concave motion path relative to said base independently of said seating surface.

4. A seating device as in claim 3 wherein said at least one supporting device comprises a back support.

5. A seating device as in claim 3 wherein said at least one supporting device comprises a stomach support.

6. A seating device as in claim 3 wherein said at least one supporting device comprises a headrest.

7. A seating device as in claim 3 wherein said at least one supporting device comprises a neck-rest.

8. A seating device as in claim 3 wherein said at least one supporting device comprises a shoulder-rest.

9. A seating device as in claim 3 wherein said at least one supporting device comprises a lumbar support.

10. A seating device as in claim 2 wherein said at least one supporting device comprises at least one lateral support supporting the upper body under the armpits.

11. A seating device as in claim 2 wherein said at least one supporting device comprises a chin-support.

12. A seating device as in claim 1 further including at least one arm support resiliently connected to said base and comprising at least one forearm support that is resiliently displaceable in at least a horizontal direction.

13. A seating device as in claim 12 wherein said resilient arm support comprises a suspended mount mechanism.

14. A seating device as in claim 13 wherein said arm support further includes a lock.

15. A seating device as in claim 1 further including at least one lower leg support having a footrest, wherein said lower leg support is connected to said seating surface by a mounting device and is connected to said base.

16. A seating device as in claim 1 further including at least one leg-rest/footrest connected to said base, wherein said leg-rest/footrest is movable relative to said base and relative to said seating surface and is lockably mounted on said base at an angled position by a rod or mounting plates or guides.

17. A seating device as in claim 1 wherein said number of said first period of motion is chosen to be twice as large as said number of said second period of motion.

18. A seating device as in claim 17 wherein said at least one point of said seating surface is shifted about a center of motion that is alterable.

19. A seating device as in claim 18 wherein said center of motion is altered depending on a displacement of said seating surface about said center of motion.

20. A seating device as in claim 19 wherein an angle of inclination of said seating surface is displaceable in a sitting direction and laterally.

21. A seating device as in claim 20 wherein said seating surface is displaceable in a forward direction, in a backward direction and laterally.

* * * * *